US005195446A

United States Patent [19]

Riddell

[11] Patent Number: 5,195,446

[45] Date of Patent: * Mar. 23, 1993

[54] APPARATUS AND METHOD FOR COVERING OPENINGS IN HULLS OF DAMAGED SHIPS

[76] Inventor: Floyd A. Riddell, 15835 Rippling Water Dr., Houston, Tex. 77084-2935

[ * ] Notice: The portion of the term of this patent subsequent to Aug. 13, 2008 has been disclaimed.

[21] Appl. No.: 743,996

[22] Filed: Aug. 12, 1991

Related U.S. Application Data

[63] Continuation-in-part of Ser. No. 512,352, Apr. 23, 1990, abandoned, which is a continuation-in-part of Ser. No. 498,012, Mar. 23, 1990, Pat. No. 5,038,701.

[51] Int. Cl.[5] ..... B63B 43/16

[52] U.S. Cl. ..... 114/229; 114/227

[58] Field of Search ..... 114/227-229, 114/221-222, 74 R; 405/12, 60, 65; 220/230, 232

[56] References Cited

U.S. PATENT DOCUMENTS

| | | | |
|---|---|---|---|
| 932,720 | 8/1909 | Reinhardt | 114/229 |
| 1,122,047 | 12/1914 | Villiers | 114/229 |
| 4,303,036 | 12/1981 | Stanley, Jr. | 114/227 |
| 5,025,972 | 6/1991 | Finlan | 114/227 |
| 5,038,701 | 8/1991 | Riddell | 114/229 |

*Primary Examiner*—Edwin L. Swinehart
*Attorney, Agent, or Firm*—Dodge, Bush, Moseley & Riddle

[57] ABSTRACT

An apparatus and method for covering an opening (14) in the damaged metal hull (12) of a ship (10) including a flexible covering material (16) having a plurality of electromagnets (36) embedded therein between inner and outer layers (30, 34) and arranged in generally transverse rows. Electrical energy is applied in sequence to the electromagnets (36) after unrolling of the flexible material (16) alongside the hull (12) between the lowermost row of electromagnets (36) and the uppermost row of electromagnets (36). Fluid assist members (48) are provided to force the flexible material (16) toward the hull (12).

17 Claims, 3 Drawing Sheets

APPARATUS AND METHOD FOR COVERING OPENINGS IN HULLS OF DAMAGED SHIPS

REFERENCE TO RELATED APPLICATIONS

This application is a continuation-in-part of application Ser. No. 513,352 filed Apr. 23, 1990, now abandoned; which is a continuation-in-part of application Ser. No. 498,012 filed Mar. 23, 1990, now U.S. Pat. No. 5,038,701 dated Aug. 13, 1991.

FIELD OF THE INVENTION

This invention relates to an apparatus and method for covering openings in the hulls of damaged ships and more particularly, to such an apparatus and method for the exterior covering of an opening in the hull of a ship resulting from accidents to block or restrict flow of liquid lading, such as oil, from the ship.

BACKGROUND OF THE INVENTION

Heretofore, various methods and means have been provided to cover an opening in the damaged hull of a ship resulting from a collision or the like.

Such prior art methods and means have included a flexible covering utilized with magnets to hold the covering onto the metal hull of a ship over an opening. For example, U.S. Pat. No. 770,078 dated Sep. 13, 1904 shows a magnetic curtain for covering leaks in ships with the curtain being unrolled alongside the ship over a hole provided in the hull. Magnets secured to the flexible curtain assist the water pressure in holding the curtain against the hull.

U.S. Pat. No. 932,720 dated Aug. 31, 1909 shows means for closing holes in a steel hull in which a series of magnets may be energized for securing an inflatable bag or blanket to the hull. The blanket is made of a strong material impervious to water or air, such as canvas and rubber combined. U.S. Pat. No. 3,669,055 dated Jun. 13, 1972 shown an apparatus and method for sealing a vessel opening in which anchoring devices for a cover over an opening in a hull are provided adjacent lower corners of the cover and are secured to the hull by electromagnets. The cover is formed of an elastomeric material such as rubber and the outer layer has an armored covering to protect the cover form sharp jagged edges about the opening in the hull.

Such prior art means such as the above, do not utilize electromagnets which may be precisely controlled individually or sequentially in predetermined groups for sequentially mounting flexible covering means over an opening in the hull from one end of the covering means to the opposite end thereof.

SUMMARY OF THE INVENTION

This invention is directed to an apparatus and method for covering an opening in the damaged hull of a ship from the outside of the hull to block leakage of liquid lading, such as oil from the ship. A roll of liquid impermeable flexible material containing a plurality of spaced electromagnets arranged in transversely extending rows is unrolled alongside the outer surface of the steel hull to form a cover. The rows of eletromagnets are electrically energized in a predetermined sequence from one end of the cover to the other end thereof after the unrolling of the flexible material thereby to secure the flexible liquid impermeable material to the metal hull of the ship. Each electromagnet is preferably of a cylindrical shape adapted to be individually controlled, if desired, and the eletromagnets are preferably positioned in a plurality of closely spaced horizontal rows. The horizontal rows of electromagnets may be energized in sequence between the uppermost row and the lowermost row after the flexible covering material is unrolled along the side of the metal hull. The cylindrical electromagnets are easily embedded or positioned between inner and outer layers of the flexible material or cover and may be suitably sealed therebetween with a bonding material.

In addition, fluid assist elements or members are provided adjacent each of the cylindrical electromagnets to force or urge the flexible material and associated electromagnets toward the steel hull for contact therewith upon a supply of fluid, such as water, provided to the fluid assist elements. Fluid supply lines to the assist elements may be secured to the flexible cover by a suitable flexible plastic material.

Also, a separate flotation device may be provided for transport of the rolled up cover a predetermined distance, such as 10 to 50 feet, from the hull of the ship prior to unrolling of the cover. In this manner the effect of any leaking fluid against the cover prior to securement will be minimized.

It is an object of this invention to provide an apparatus and method for covering an opening in a hull of a damaged ship to block or restrict the flow of liquid lading therefrom.

It is a further object of this invention to provide such a method and means in which the covering material includes a plurality of electromagnets arranged generally in horizontal rows with the electromagnets being energized in sequence between uppermost and lowermost rows.

An additional object of this invention is to provide separate means to assist in forcing the flexible covering material toward the metal hull to a position where the electromagnets will be magnetically attached for securing the flexible material thereto.

Another object of this invention is to provide a flotation device for transport of the rolled up flexible covering material away from the damaged ship prior to release or unrolling of the flexible covering material.

Other objects, features, and advantages of this invention will become more apparent after referring to the following specification and drawings.

DESCRIPTION OF THE INVENTION

Figure 2:
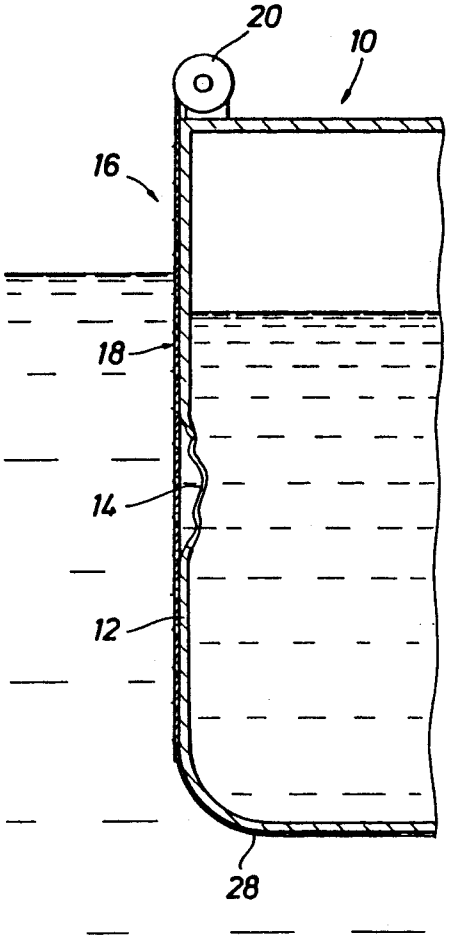
FIG. 2 is a section taken generally along line 2—2 and showing the covering material in position along the hull.

Referring to the drawings, a ship is indicated partially at 10 having a metal hull 12 in which a hole or opening shown at 14 has been ripped resulting from a collision or the like. Flexible covering means comprising this invention and generally indicated at 16 is shown secured to the outer surface of metal hull 12 and covering the jagged hole 14 to restrict or stop the flow of a liquid lading therefrom, such as oil or the like.

Flexible covering means or cover 16 includes a flexible material generally indicated at 18 and being impermeable to fluids. Flexible material 18 is wound onto a roll or reel 20 having end supports 22 for lowering alongside the outer surface of metal hull 12. A motor shown at M may be provided for reeling or unreeling roll 20.

Figure 1:
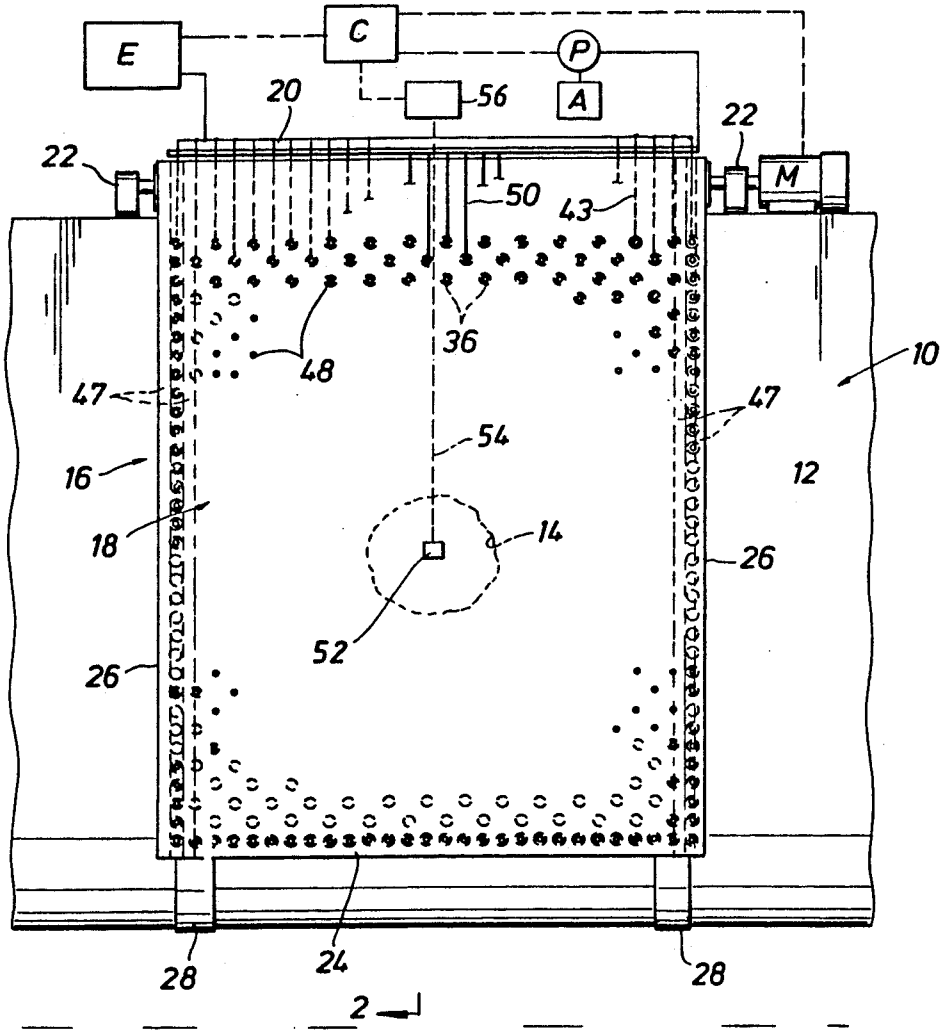
FIG. 1 is a side elevation of a portion of the hull of a ship showing the rectangular covering material comprising the present invention unrolled alongside the outer surface of the hull and covering the hole or opening ripped in the side of the hull.

FIG. 1 shows flexible material 18 of a generally rectangular shape magnetically secured to hull 12 and having a lower end 24, parallel sides 26, and an upper end on roll 20. Suitable straps 28 may be attached to end 24 for securement about hull 12 as may be desired under certain conditions. Means (not shown) may be provided to release and propel straps 28 beneath hull 12 to the opposite side thereof upon securement of flexible material 18 on hull 12 with straps 28 being pulled taut from the opposite side of the hull to additionally secure flexible material 18 on hull 12, such as might be required in the event of a malfunction of power sources, for example.

Figure 3:
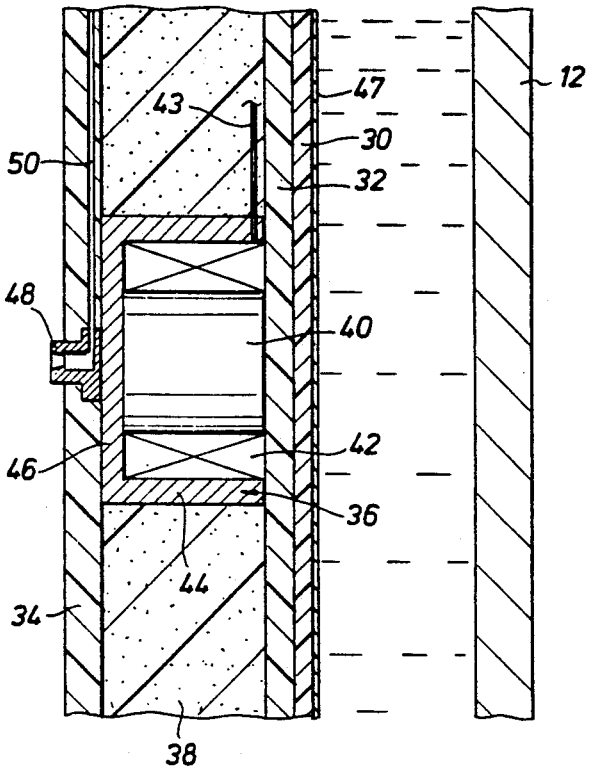
FIG. 3 is an enlarged cross section of a portion of the covering material showing an electromagnet and associated fluid assist means thereon for directing or forcing the flexible covering material toward the hull.
Figure 4:
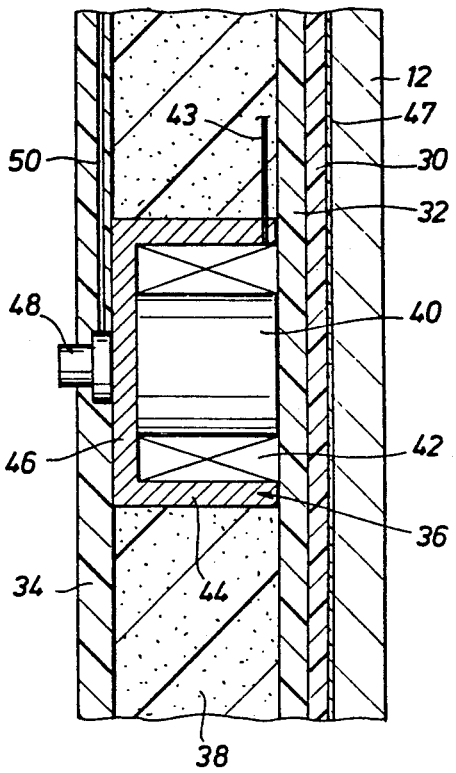
FIG. 4 is a section similar to FIG. 3 but showing the electromagnet in engagement with the metal hull of the ship.

Referring now to FIGS. 3 and 4 in which flexible material 18 is specifically illustrated, an inner layer 30 is provided from a tough elastomeric material, such as sold under the trade name "Hyperlastic" by Gundle Lining Systems, Inc., 19103 Gundle Road, Houston, Tex. and having a thickness of around 0.030 inch. A protective intermediate layer 32 is provided adacent inner layer 30 and may be formed of a suitable "Kevlar" (a registered trademark of DuPont) material such as sold under the designation "VKWF162" by Advanced Textiles, Inc., Seguin, Tex. and having a thickness of around 0.020 inch. An outer tough protective layer 32 is provided likewise formed of a suitable "Kevlar" material with a flexible type sealer material combined with the "Kevlar" outer layer 34. Embedded or sandwiched between intermediate layer 32 and outer layer 34 are a plurality of spaced electromagnets each generally indicated at 36 and arranged in a plurality of generally transverse rows extending from the upper end of flexible material 18 to the lower end 24 thereof across the entire width of flexible material 18 between parallel sides 26. Electromagnets 36 are preferably cylindrical in shape and may, for example, be of a size having a diameter of 3½ inches and a height of 1½ inches and spaced around 4 to 6 inches from each other in the trasverse rows. Electromagnets 36 and adjacent rows are staggered. A flexible filler material of a suitable plastic material is positioned about electromagnets 36 between intermediate layer 32 and outer layer 34. Thus, flexible material 18 has a total thickness of around 1¾ inches.

Each electromagnet 36 has a central iron core 40, a winding 42 surrounding iron core 40, a cylindrical plastic outer case 44 about winding 42, and a plastic cover 46. An electrical wire or conduit 43 is provided for each electromagnet 36. As an example of a suitable electromagnet 36, and electromagnet designated as "EM-R35" is sold by Master Magnetics, Inc., Castle Rock, Colo. having a diameter of 3½ inches, a height of 1½ inches, and operating at 8 watts to exert a magnetic pull of 650 pounds. It may be desirable to provide additional wattage in order to increase the magnetic pull for certain operating conditions. The number of electromagnets 36 is increased along sides 26 and end 24 in order to provide additional securing strength along the lower end and sides of flexible material 18.

Figure 5:
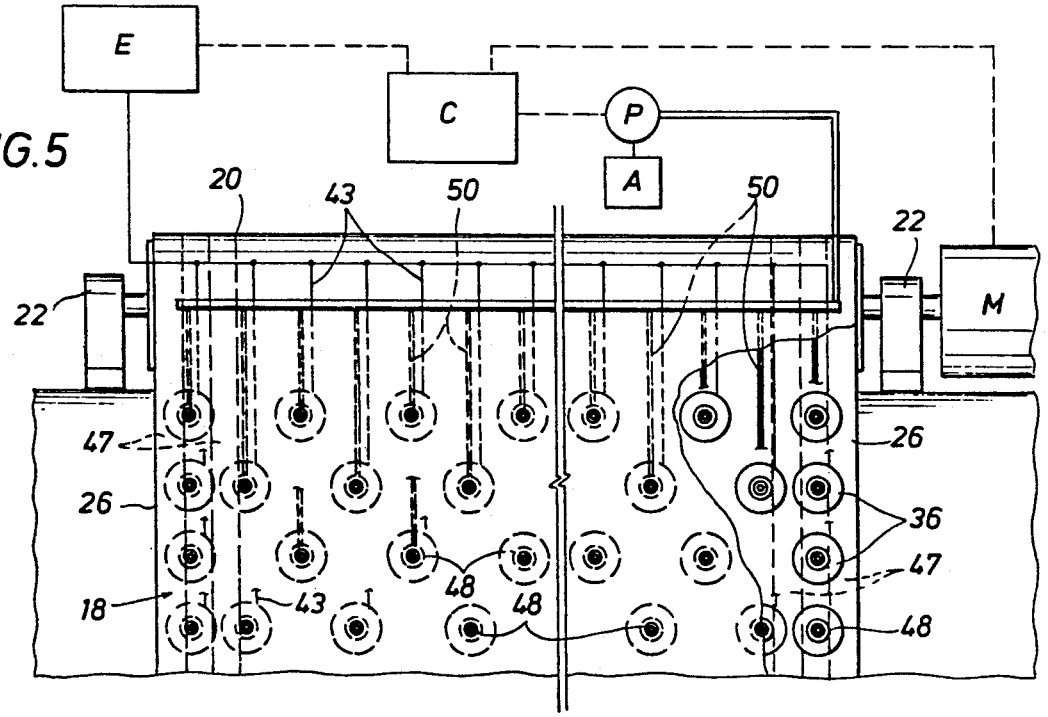
FIG. 5 is an enlarged fragment of FIG. 1 showing generally schematically the controls and power sources for the operation of the covering means of the present invention.

Further, as shown in FIGS. 1 and 5, a pair of flexible strips 47 of permanent magnetic material are provided along inner marginal portions of vertical sides 26 for being magnetically attacted to hull 12 when flexible material 16 is applied to hull 12. Magnetic strips 47 may, for example, be around ⅛ inch in thickness and four (4) inches in width and when flexible material 16 is in place on hull 12 strips 47 will minimize the entry of sea water between hull 12 and flexible material 16.

While electromagnets 36 and magnetic strips 47 may be adequate to provide sufficient magnetic attraction to metal hull 12 under most operating conditions, it may be necessary to provide additional means to assist in directing or forcing flexible material 18 toward steel hull 12 for securement by electromagnets 36. For this purpose, a fluid assist member is shown at 48 for each electromagnet 36 positioned centrally on the outer cover 46 of electromagnet 36. A fluid conduit or line 50 extends to fluid assist member 48 and upon the supply of fluid, such as water, to fluid assist member 48, a fluid jet is directed outwardly of electromagnet 36 with the opposite end forcing or pushing electromagnet 36 in a direction toward hull 12. A suitable source of water is shown at A and pump P supplies water to conduits or lines 50 embedded in flexible material 18. Likewise, electrical conduits 43 to electromagnets 36 are embedded in flexible material 18 with the electrical current being supplied by a suitable source of electrical energy shown at E.

Cover 16 when unrolled may be of a generally square shape of a width and length of around ten feet, for example. It is desirable that the center of cover 16 be positioned over the center of the hole 14 and for that purpose a transducer 52 is secured to cover 16 at its center and a suitable line 54 extends to a display monitor 56 on ship 10 which includes a liquid crystal display. Electrical signals from transducer 52 will locate hole 14 and cover 16 may then be positioned over the center of hole 14.

A control panel is shown at C to control motor M to wind and unwind flexible material 18, to control the energizing and de-energizing of electromagnets 36, to control the supply of water to fluid assist members 48, and to monitor display monitor 56. It is noted that a separate electrical line 43 is provided for each electromagnet 36 with each electromagnet having a designated number and position on flexible material 18 for monitoring. Selective rows of electromagnets 36 may be energized or de-energized as desired. Control panel C together with roll 20 may be mounted on a movable carriage or the like for positioning on a desired area of the ship.

In operation, roll 20 is unrolled upon energizing motor M alongside the outer surface of hull 12 to a length sufficient to adequately cover hole 14. Transducer 52 and display monitor 56 are utilized to position cover 18 centrally over hole 14. Then, horizontal rows of electromagnets 36 are energized in sequence beginning preferably with the lowermost row of electromagnets 36 adjacent lower end 24 and continuing to the uppermost row of electromagnets 36. If needed, fluid assist members 48 may be utilized to force flexible material 18 closely adjacent hull 12 so that adequate magnetic attraction is provided by magnetic strips 47 and upon energizing of electromagnets 36 to secure properly flexible material 18 against steel hull 12. Straps 28 may be propelled beneath hull 12 to the opposite side thereof by suitable means (not shown) for securement to the opposite side of hull 12.

Figure 6:
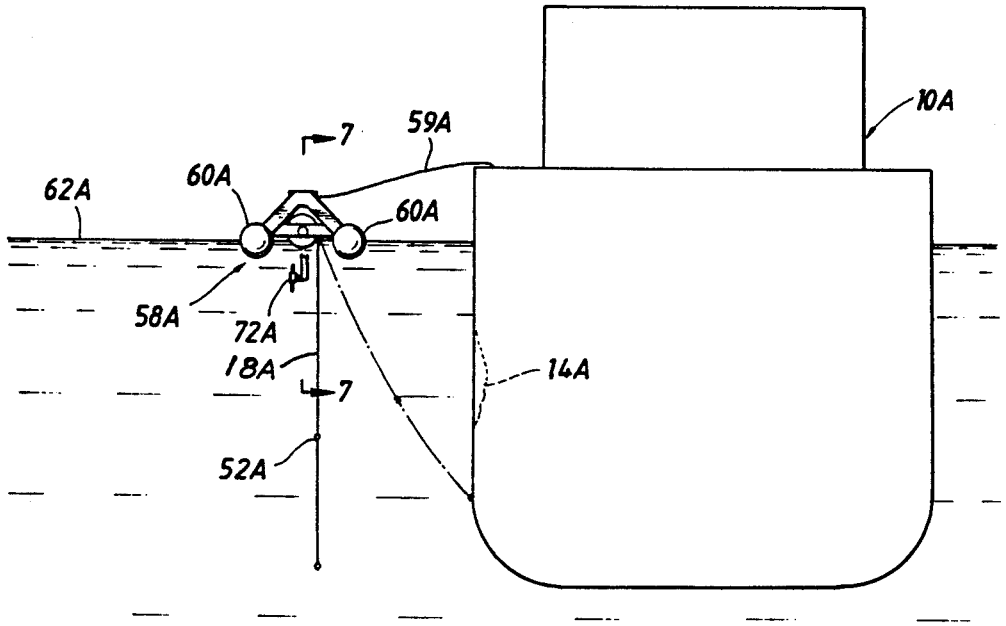
FIG. 6 is primarily a schematic view of another embodiment of the invention in which a flotation device is provided to support the flexible covering material for transportation away from the damaged ship prior to use.
Figure 7:
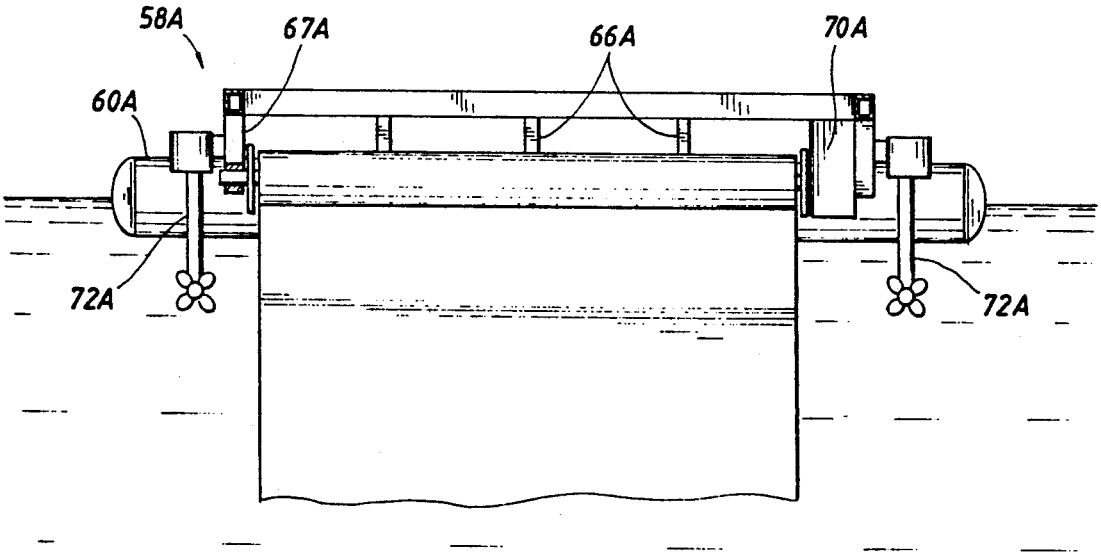
FIG. 7 is a side elevation of the flotation device shown in FIG. 6.

Referring now to FIGS. 6 and 7, an embodiment is illustrated for the transport of the covering material away from the damaged ship prior to unrolling the covering material. Leaking fluids, such as crude oil, from an opening in the hull of the ship may tend to force the covering material away from the ship and it is desirable to first secure the lower end of the covering material against the hull with minimal force being exerted by the leaking fluid. For this purpose a separate flotation device generally indicated at 58A is shown adjacent ship 10A. Flotation device 58A may, if desired, be remotely controlled by a control line 59A extending from ship 10A. Flotation device 58A includes a pair or buoyant cylindrical members 60A for floating on the upper surface 62A of the sea water. A support member 64A is supported on cylindrical members 60A by bracing frame members 66A. Hanger brackets 67A on the ends of support member 64A mount a shaft 68A on which flexible covering material or cover 18A is rolled. A motor 70A on support member 64A is provided to rotate shaft 68A for unrolling flexible covering material 18A. A trolling motor 72A such as a six horsepower motor is provided on hanger brackets 67A at each end of flotation device 58A for propelling flotation device 58A through line 59A from ship 10A.

In operation, flotation device 58A with rolled up cover 18A is lowered into the sea from ship 10A and steered by trolling motors 72A to a desired location away from ship 10A. Motor 70A is energized to unroll cover 18A and transducer 52A on cover 18A is energized to position flotation device 58A accurately with respect to opening 14A in the hull of ship 10A. Then fluid assist devices on cover 18A are energized to move cover 18A toward the hull with the lowermost row of electromagnets being secured first below opening 14A. Adjacent rows of electromagnets are energized in sequence for securing cover 18A over opening 14A. Thus, the flow of leaking fluid from ship 62A is gradually reduced to a minimum.

It may be desirable in some instances to fold flexible cover 18A in a plurality of layers and then tie the cover by cables to support member 62A with the upper end of cover 18A supported from support member 62A. Release of the cable would release cover 18A for extension within the sea adjacent the hull of ship 10A.

It is to be understood that the present invention may be provided in a portable packaging arrangement for transport to a ship where needed. Also, a ship might be fitted with suitable sources of electrical energy and fluid at a predetermined location to adapt itself for the use of such a flexible covering means. Suitable remote controlled winches may be utilized for the winding of electric lines and fluid lines as desirable.

While preferred embodiments of the present invention have been illustrated in detail, it is apparent that modifications or adaptations of the preferred embodiments will occur to those skilled in the art. However, it is to be expressly understood that such modifications and adaptations are within the spirit and scope of the present invention as set forth in the following claims.

What is claimed is:

1. In a ship particularly adapted for the transport of liquid lading and having a metal hull;

improved means for covering an opening in the metal hull resulting from accidents to block the flow of liquid lading from the hull, said improved means comprising:

a coiled roll of flexible covering material adapted to be positioned alongside the outer surface of the metal hull over the opening in the hull, said covering material being formed of a liquid impermeable material and having a plurality of electromagnets arranged in generally transverse rows from the upper end of said covering material to the lower end thereof upon the positioning of the material along the hull of the ship;

means to unroll said covering material along the outer surface of the hull for covering said opening;

a fluid assist device attached to said flexible material to urge said material toward said hull; and means to supply electrical current to said electromagnets in sequence to said transverse rows between the upper end of said covering material and the lower end of said covering material for securing said magnets electrically to said hull in sequence.

2. In a ship as set forth in claim 1;

said fluid assist device including means to urge said electromagnets toward the hull of said ship for magnetically securing said electromagnets.

3. Covering means for positioning over an opening in the metal hull of a ship resulting from an accident to block the flow of liquid lading from the hull; said covering means comprising:

a flexible liquid inpermeable material having a plurality of spaced electromagnets enbedded therein for magnetic securement to said metal hull, said electromagnets being embedded in a plurality of generally transversely extending rows for being electrically energized in sequence between the uppermost row and the lowermost row;

said liquid impermeable flexible material including an inner elastomeric layer contacting the hull, a flexible intermediate high strength plastic layer adjacent said inner layer, and a flexible high strength outer layer; and means to supply electrical energy to said electromagnets in sequence to said transverse rows between the upper end of said flexible material and the lower end thereof upon the positioning of said material along the hull of the ship.

4. Covering means for positioning over an opening in the metal hull of a ship resulting from an accident to block the flow of liquid lading from the hull; said covering means comprising:

a flexible liquid impermeable material having a plurality of spaced electromagnets embedded therein for magnetic securement to said metal hull, said electromagnets being embedded in a plurality of generally transversely extending rows for being electrically energized in sequence from the uppermost row to the lower row;

a flexible strip of permanent magnetic material positioned along opposed vertical sides of said flexible material for securement to said hull; and means to supply electrical energy to said electromagnets in sequence to said transverse rows between the upper end of said flexible material and the lower end thereof, upon the positioning of said material along the hull of the ship.

5. Covering means as set forth in claim 4 wherein said flexible strip is continuous and of a thickness around ⅛ inch.

6. Covering means for a ship hull as set forth in claim 4;

control means for said electrical energy to supply a predetermined current to predetermined electromagnets in sequence generally from the uppermost magnets to the lowermost magnets thereby to permit the securement of the flexible material against the metal hull of the ship in sequence from the upper end of the covering means to the lower end thereof after the flexible material is unrolled alongside the hull.

7. Covering means for positioning over an opening in the metal hull of a ship resulting from an accident to block the flow of liquid lading from the hull; said covering means comprising:

a flexible liquid impermeable material having a plurality of spaced electromagnets embedded therein for magnetic securement to said metal hull, said electromagnets being embedded in a plurality of generally transversely extending rows for being electrically energized in sequence from the uppermost row to the lowermost row;

means to urge said electromagnets toward the hull of said ship for magnetic securement of said electromagnets to said hull; and means to supply electrical energy to said electromagnets in sequence to said transverse rows between the upper end of said flexible material and the lower end thereof, upon the positioning of said material along the hull of the ship.

8. A method of mounting a covering material over an opening in a damaged metal hull of a ship to restrict or block the flow of liquid lading from the hull; said method comprising the following steps:

forming a flexible covering material including an inner layer and an outer layer with a plurality of spaced electromagnets embedded between the inner and outer layers generally in a plurality of transversely extending rows;

winding said flexible material into a roll;

unwinding the roll of flexible material alongside the hull over the opening in the hull;

applying electrical energy in sequence to said electromagnets between the uppermost row and the lowermost row for magnetic securement of said electromagnets;

providing a plurality of spaced fluid assist members on said flexible covering material; and providing a supply of water to selected fluid assist members upon positioning of the flexible covering material alongside the hull of the ship for forcing the flexible covering material toward the metal hull for magnetic securement of said electromagnets.

9. A method as set forth in claim 8 including the steps of providing fluid conduits in said flexible material to said fluid assist members; and embedding said fluid conduits within said flexible material for securing said fluid conduits thereto.

10. Apparatus for covering an opening in the metal hull of a ship transporting liquid lading to block the flow of liquid lading from the hull; said apparatus comprising:

a flexible covering material adapted to be positioned alongside the hull of the ship adjacent the opening;

monitoring means including a transducer operatively connected with said flexible covering for locating said opening for initially positioning said flexible covering material accurately;

a plurality of electromagnets arranged on said flexible covering material between upper and lower ends thereof;

means for positioning said flexible covering material closely adjacent said opening; and means to supply electrical current to said electromagnets for securing said flexible material against said hull from the lower end of said flexible material.

11. Apparatus as set forth in claim 10 wherein said means for positioning said flexible covering material closely adjacent said opening includes fluid assist devices connected to said flexible covering material.

12. Apparatus or covering an accidental opening in a metal hull of a ship transporting liquid lading to block the flow of liquid lading from the hull; said apparatus comprising;

a separate floatation device adapted to be positioned alongside the ship in spaced relation thereto;

a flexible covering material carried by said separate floatation device and having a plurality of magnets therein positioned between an upper supported end of said covering material and a lower unsupported end of said covering material;

means for releasing said flexible covering material from said lower unsupported end for positioning said covering material adjacent said opening; and means to urge said flexible covering material toward said hull for securement of said magnets to said metal hull over said opening; said magnets being electromagnets and a source of electrical energy is provided for energizing said electromagnets; and wherein said electromagnets are energized in sequence from the lower end of said flexible material to the upper end thereof.

13. Apparatus for covering an accidental opening in a metal hull of a ship as set forth in claim 12 wherein remotely controlled propelling means are provided on said flotation device for selectively propelling said flotation device to a desired area on the water.

14. Apparatus for covering an accidental opening in a metal hull of a ship as set forth in claim 12 wherein monitoring means including a transducer is operatively connected to said flexible covering for locating said opening and initially positioning said covering material accurately.

15. Apparatus for covering an accidental opening in a metal hull of a ship as set forth in claim 14 wherein said transducer is carried by said flexible material generally centrally of said flexible material when extended alongside the hull of said ship.

16. Covering means for covering an opening in the metal hull of a ship resulting from accidents to block the flow of liquid lading from the opening in the hull; said covering means comprising:

a flexible covering material adapted to be positioned alongside the outer surface of the metal hull over the opening in the hull, said covering material having a plurality of electromagnets arranged in a predetermined pattern from an upper supported end of said covering material to a lower unsupported end thereof upon the positioning of the material along the hull of the ship;

means to urge said electromagnets toward the hull of said ship for magnetic securement of said electromagnets to said hull; and means to supply electrical current to said electromagnets between said upper end of said covering material and said lower end of said covering material in a predetermined sequential pattern for securing said magnets electrically to said hull.

17. Covering means as set forth in claim 16, said covering means comprising a coiled roll of said flexible covering material, and means to unroll said covering material along the outer surface of the hull for covering said opening.

* * * * *